US007905475B2

(12) United States Patent
Pruzan et al.

(10) Patent No.: US 7,905,475 B2
(45) Date of Patent: Mar. 15, 2011

(54) AERODYNAMIC POSITIONING DEVICE

(75) Inventors: Daniel A. Pruzan, Redwood City, CA (US); Michael R. Mendenhall, Los Gatos, CA (US); Patrick H. Reisenthel, Pleasanton, CA (US); Daniel J. Lesieutre, San Jose, CA (US); Marnix F. E. Dillenius, Palo Alto, CA (US); Robert E. Childs, Mountain View, CA (US)

(73) Assignee: Neilsen Engineering & Research, Inc., Santa Clara, CA (US)

( * ) Notice: Subject to any disclaimer, the term of this patent is extended or adjusted under 35 U.S.C. 154(b) by 163 days.

(21) Appl. No.: 12/358,202

(22) Filed: Jan. 22, 2009

(65) Prior Publication Data

US 2009/0184453 A1 Jul. 23, 2009

Related U.S. Application Data

(60) Provisional application No. 61/022,821, filed on Jan. 23, 2008.

(51) Int. Cl.
*B42B 2/00* (2006.01)

(52) U.S. Cl. ..... 270/52.28; 270/52.26; 270/52.27

(58) Field of Classification Search ..... 270/52.26, 270/52.27, 52.28, 52.29
See application file for complete search history.

(56) References Cited

U.S. PATENT DOCUMENTS

| | | | | |
|---|---|---|---|---|
| 1,614,717 | A | 1/1927 | Christensen | |
| 3,663,007 | A | 5/1972 | Preiter | |
| 4,085,927 | A * | 4/1978 | Muller | 270/52.29 |
| 4,493,482 | A * | 1/1985 | Valenti et al. | 270/12 |
| 4,576,369 | A * | 3/1986 | Flensburg et al. | 270/52.17 |
| 5,028,193 | A | 7/1991 | Misicka | |
| 5,067,700 | A * | 11/1991 | Dick | 270/52.29 |
| 6,517,064 | B2 * | 2/2003 | Glanzmann | 270/52.28 |

* cited by examiner

*Primary Examiner* — Patrick Mackey
(74) *Attorney, Agent, or Firm* — Carr & Ferrell LLP

(57) ABSTRACT

The gathering, conveyance, and assembly of printed material utilizing one or more aerodynamic positioning devices in conjunction with binding machinery is disclosed. The aerodynamic positioning device utilizes controlled fluid flow via a series of discretely spaced jets that create a low pressure region beneath a signature dropping from an adjacent feeder. The aerodynamic positioning device allows the binding machinery to operate at high speeds with lightweight and unbalanced signatures while maintaining high-quality production with reduced paper jams.

28 Claims, 4 Drawing Sheets

AERODYNAMIC POSITIONING DEVICE

CROSS REFERENCE TO RELATED APPLICATIONS

The present application claims the priority benefit of U.S. provisional patent application No. 61/022,821 filed Jan. 23, 2008 and entitled "Aerodynamic Positioning Device," the disclosure of which is incorporated herein by reference.

BACKGROUND OF THE INVENTION

1. Field of the Invention

The present invention generally relates to binding of printed material. More specifically, the present invention relates to the gathering and conveying of printed sheets of material along a segmented gathering chain through the use of controlled air flow allowing for more efficient binding of lightweight and unbalanced signatures at high speeds.

2. Description of the Related Art

Sheets of printed materials that comprise magazines, brochures, and catalogs are often bound into distributable form using equipment known as a saddle stitcher. These sheets—or signatures (i.e., a section of the printed document comprising multiple pages)—of printed materials are obtained from a series of sequential sheet feeders. The printed materials are then advanced down an assembly line utilizing pushers on a gathering chain. The gathering chain continuously moves the folded signatures from the feeders to a portion of the saddle stitcher including a series of stitching heads. The saddle stitcher positions the folded and draped signatures beneath the stitching heads where the printed materials are stapled and bound along their spine.

Certain printed materials are high-volume and time sensitive. For example, a weekly news magazine such as Time has a circulation between three and four million copies. Each of those three to four million copies is inclusive of approximately more than 100 pages of news and advertising content. Each of those three to four million copies must be delivered to a subscriber mailing address or news stand no later than a certain date or the time sensitive news and advertising content will become obsolete making the publication worthless. This high-volume and time sensitive demand can, to a certain extent, be met by increasing the capacity of a binding operation. Through the use of an increased number of saddle stitching machines, more copies of a magazine can be assembled, bound, and eventually delivered to subscribers.

Saddle stitching machines, however, require a significant capital investment and subsequent upkeep and maintenance. Personnel must be employed and trained to monitor each machine utilized in the binding process. A large enough facility to house a saddle stitching machine (or machines) must be procured to protect the machine and printed material from the elements. Scaling a binding operation thus incurs significant costs, which may quickly outweigh the return on investment with respect to increased processing capability.

As an alternative to increasing the scale of publishing operations, attempts have been made to meet high-volume and time sensitive publication demands by increasing the production speed and throughput of available saddle stitching lines. But when prior art saddle stitching equipment is run at high speeds with lightweight and unbalanced signatures (e.g., the number of pages on the front side of a spine is different than the number on the backside), which is especially common in the periodicals industry, poor production quality and paper jams result.

As a folded signature transitions from a feeder to the gathering chain during high-speed operation, the air pressure beneath the signature can cause pages to 'parachute' outwards. The 'parachuting' of the signature often results in paper jams and 'dog earring'—the curling of the page's lower downstream corner. This phenomenon becomes more prevalent as the speed of the stitching line is increased. As the speed of the stitching line is increased, so does the velocity at which a signature impacts the gathering chain. The resulting impact can cause the signature to 'bounce' and entirely roll off the gathering chain. This latter phenomenon is especially prevalent with unbalanced signatures.

A lesser quality publication results when the binding process continues at high speed without adequately addressing these issues. For example, magazines may be bound with folded, torn, or missing pages. These adverse results are of great concern to advertisers whose message may not be properly conveyed to a subscriber. If an advertiser is unable to convey their message due to the unreliable or low quality nature of a particular publication, the advertiser will discontinue their relationship with the publication. The publication, as a result, loses a critical source of revenue to maintain publishing operations.

Also of great concern with respect to high-speed binding is that paper jams may result in the saddle stitching machinery. Once a paper jam occurs due to shifted, folded, or misaligned materials, the entire saddle stitching machine must be taken off line. The jam must then be located and removed, and the stitching machine then brought back online to continue binding operations. Bringing a stitching machine back online may include having to bind additional copies of previously albeit improperly bound materials ruined as a result of the paper jam. These delays could significantly impact the on-time delivery of a publication, which may be devastating to the publication if the content is time-sensitive. As a result, bindery lines that include lightweight and unbalanced signatures are typically operated at speeds well below the maximum throughput capacity of the saddle stitching equipment.

Prior art systems attempt to control the transition of signatures from a feeder to the gathering chain through the use of mechanical adjustments within the feeder and a number of external, adjustable air jets that impinge on the outside faces—front side and backside—of a new signature being added to a document in production. Notwithstanding, these prior art systems continue to result in signatures parachuting, dog earring, bouncing, and rolling off the gathering chain. These continued difficulties are directly related to the high speed of signature travel from a feeder to the gathering chain, the generally light weight of the signatures, and the unbalanced constitution of the signatures.

There is, therefore, a need in the art to allow for the time-sensitive and high-volume binding of printed materials that takes into account the weight and constitution of the printed materials as to avoid complications that may result from high-speed operation.

SUMMARY OF THE CLAIMED INVENTION

In a first claimed embodiment, a system for positioning a plurality of signatures for binding is claimed. The system includes a gathering chain to transport signatures to a stitching head. The system further includes a series of swords configured to separate a new signature from a document in production. Vent caps create airflow that expands and flows downward in an essentially inviscid manner resulting in a low-pressure region beneath the new signature when deposited by a feeder onto the document in production. As a result, the new signature conforms to and is aligned with the document in production. Nor does the new signature deviate from the gathering chain as a result of the generation of the low-pressure area. A stitching head binds the new signature with the document in production.

A second claimed embodiment also recites a system for positioning a plurality of signatures for binding. The second claimed embodiment also includes a gathering chain but instead recites a series of plates to separate a new signature from a document in production. Vent caps create airflow that expands and flows downward in an essentially inviscid manner resulting in a low-pressure region beneath the new signature when deposited by a feeder onto the plates and document in production whereby the new signature conforms to the plates and is aligned with the document in production nor does the new signature deviate from the gathering chain. A stitching head binds the new signature with the document in production.

A third recited embodiment is for a method for positioning signatures for binding. Through the method, a controlled airflow is generated beneath a signature deposited by a feeder onto a document in production. The document in production is located on a gathering chain. A low pressure area is created by directing the controlled airflow into a region beneath the deposited signature where the airflow expands and flows downward in an essentially inviscid manner. The deposited signature is pulled toward the document in production whereby the new signature conforms to and is aligned with the document in production nor does the new signature deviate from the gathering chain. The new signature is then bound with the document in production.

DETAILED DESCRIPTION

Embodiments of the presently disclosed invention allow for the gathering, conveyance, and assembly of printed material utilizing one or more aerodynamic positioning devices (APDs) in conjunction with binding machinery. The APD utilizes controlled fluid flow via a series of discretely and laterally spaced jets. In contrast to prior art systems that direct air on the outside faces of a transitioning signature, the APD employs air flowing beneath a signature transitioning from a feeder to the gathering chain. The laterally spread jets are configured to create expanding and essentially inviscid airflows that result in a low pressure region, which allows the binding machinery to control the motion of printed materials notwithstanding particularities of weight and constitution. Difficulties that are normally encountered during the high-speed conveyance and binding process may be obviated.

By utilizing air flow to generate low pressure between a new signature and either the APD plate or the document in production, the transition of the new signature from a feeder to the gathering chain may be controlled to eliminate 'parachuting' and 'bouncing.' Air flow and pressure control through the use of the presently disclosed APD may likewise contribute to the prevention of dog earring in the new signature and the rolling of the signature off the gathering chain. Paper jams, which contribute to significant delays in the binding and distribution process, may also be avoided.

To aid in the understanding of the present disclosure, certain terminology is used. The term 'front side' refers to the side of a bindery line where factory personnel or binding operators might stand. In contrast, the term 'back side' refers to the opposite side of the binder line where factory personnel or binding operators are not standing. The gathering chain reflects a centerline between the front side and back side. Upstream refers to the directional source of a document in production. Upstream is the right hand of the operator when facing the centerline from the front side. 'Downstream,' in turn, is the direction that the document in production travels. Downstream is the left hand side of the operator when facing the centerline from the front side.

In operation, APD units are mounted beneath feeders to facilitate movement and control of magazine signatures as those signatures transition from a feeder to a gathering chain.

Figure 1A:
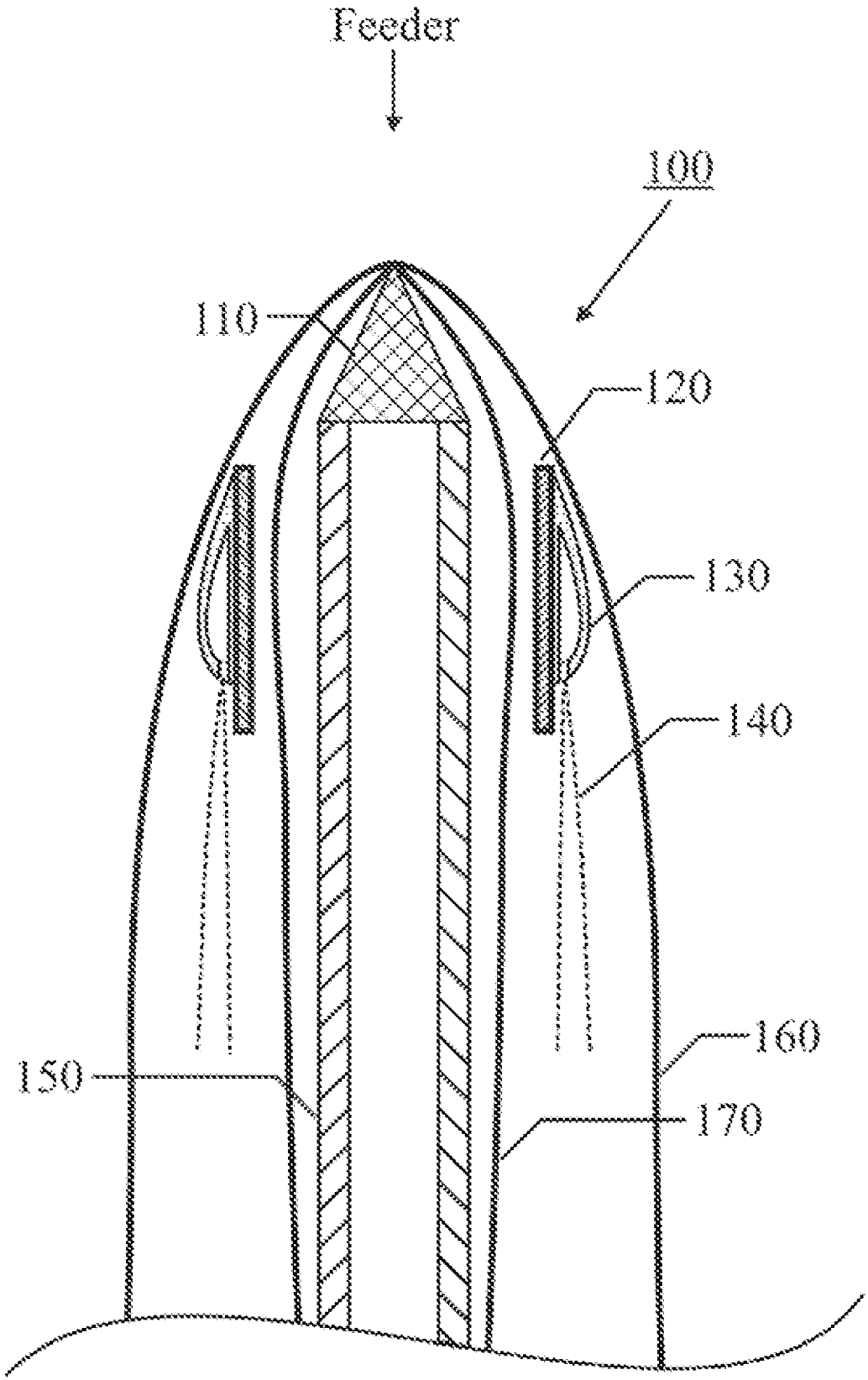
FIG. 1A illustrates an APD in cross-sectional detail.

FIG. 1A illustrates an APD 100 in cross-sectional detail. The APD 100 of FIG. 1A is implemented without an APD plate. Specifically, with respect to FIG. 1A, a gathering chain 110 is shown. The printed material to be bound (i.e., the documents in production) are lined up on the gathering chain 110 by a series of continuously moving pushers (not shown). The gathering chain 110 transports the document in production 170 to a stitching station for assembly and binding by a stitching head (not shown). FIG. 1A also illustrates, on either side, a vertically disposed guide plate 150.

FIG. 1A also depicts a sword 120, which operates to separate the new signature from the document in production. Mounted on each sword 120 is an APD vent cap 130. APD vent caps 130 supply air 140 in a downward direction along the APD 100. This air flows in an expanding, essentially inviscid manner such that low pressure is generated beneath each new signature 160 as previously described. As a result of this low pressure, the new signature 160 is pulled towards the surface of the document in production 170.

Figure 1B:
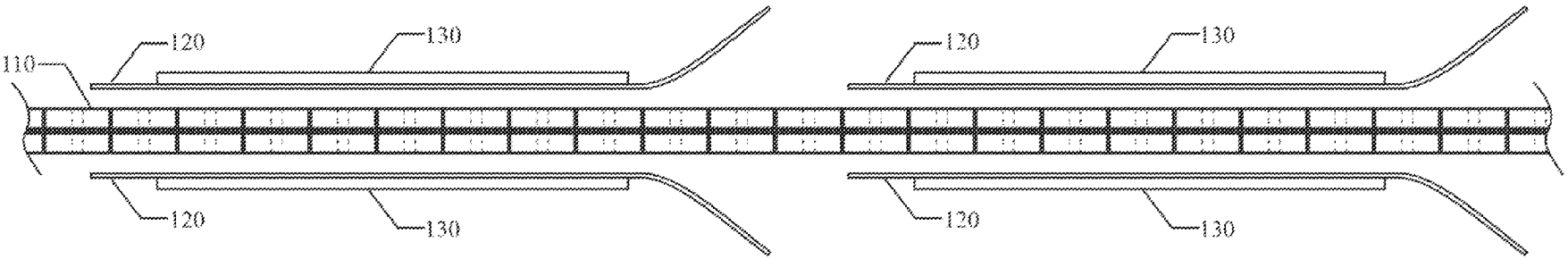
FIG. 1B illustrates a plan view of the APD depicted in FIG. 1A.
Figure 1C:
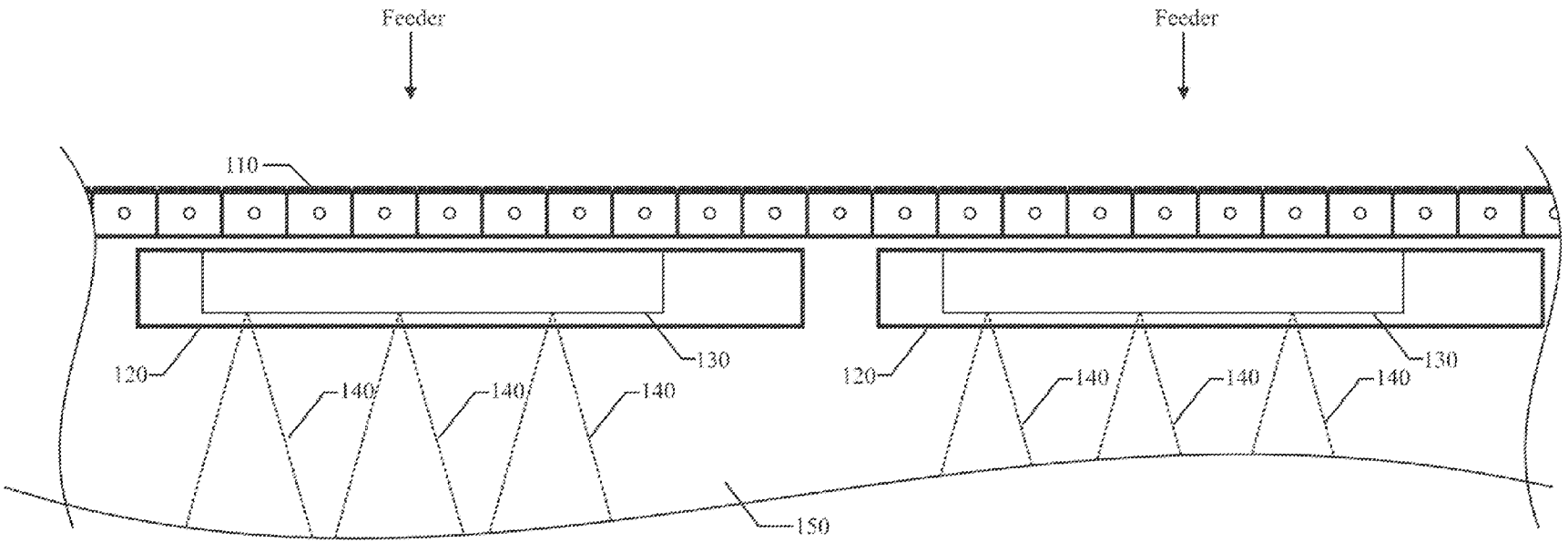
FIG. 1C illustrates an elevation view of the APD depicted in FIG. 1A and FIG. 1B.

FIG. 1B, in turn, illustrates a plan view of the APD 100. In FIG. 1B a air supply hoses, support brackets for swords 120, the document in production 170, and new signatures 160 are not illustrated in order to maintain clarity of the figure. The gathering chain 110, swords 120, and APD vent caps 130 of FIG. 1B otherwise correspond to the similarly labeled elements of FIG. 1A. FIG. 1C, in turn, illustrates an elevation view of the APD 100. Like FIG. 1B, the air supply hoses, support brackets for the swords 120, magazines in-production 170, and new signatures 160 are not shown for clarity. The gathering chain 110, swords 120, APD vent caps 130, indicia of air flow 140, and guide plate 150 of FIG. 1C otherwise correspond to the similarly labeled elements of FIG. 1A and 1B.

A document in production 170 originates from an upstream feeder and passes inside the swords 120. A new signature 160 is dropped from a feeder onto the outside faces of the swords 120 and vent caps 130. Vent caps 130 may be coupled to the swords 120 or APD plate. Alternatively, the vent caps 130 may be integrated into the swords 120 or APD plate. Compressed air, which is fed into one end of the vent caps 130, discharges from a number of openings in the lower edge of the vent caps 130 to create discrete air jets 140. These air jets 140 flow downward along either the document in production 170 or the APD plate in those embodiments implementing an APD plate. The resulting air jets 140 expand in an essentially inviscid manner to create a low pressure region that acts on the new signature 160 to control the transition of the signature 160 from the feeder to the gathering chain 110 thereby avoiding parachuting, dog earring, bouncing, and/or rolling off of the gathering chain 110.

As the signature 160 drops down from the feeder and approaches the upper edge of the APD 100, the signature 160 is pulled toward the vent caps 130 by air entrained into controlled jet streams 140. Air from the jets flows through a gap formed between the signature 160 and document in production 170 in an embodiment like those of FIGS. 1A-1C. In embodiments where the vent cap is attached to an APD plate, the jets flow through a gap formed between the APD plate and the signature.

The airflow expands and flows downward in an essentially inviscid manner resulting in a low pressure region beneath the dropping signature 160. The low pressure region generated by the controlled jet flow 140 causes the signature 160 to be pulled toward either the document in production 170 (as in FIGS. 1A-1C) or the APD plate thereby eliminating parachuting and dog earring.

The downward air stream flow 140 also promotes smooth and rapid travel of the signature 160 onto the gathering chain 110. Once the spine of the signature contacts the gathering chain 110, a small but sufficient amount of friction between the APD vent caps 130 and the signature 160 due to the latter wrapping around the APD vent caps prevents the signature from bouncing and from rolling off of the chain.

A particularly advantageous APD that generally corresponds to the APD 100 of FIG. 1 has been manufactured and implemented. That particular APD utilizes a tear drop shaped vent cap, which is attached to the sword of the saddle stitching equipment. Each vent cap includes three openings. A flow rate of approximately 5 cubic feet per minute per vent cap was used. A flow rate of between 4 to 6 cubic feet is preferred.

As noted above, the jets of FIG. 1C create a flow field 140 near the upper edge of the APD 100 to cause the signature 160 to be pulled toward the APD vent caps 130. The jets likewise create a low-pressure area 140 between the signature 160 and either the document in production 170 or the APD plate, depending on implementation of a particular embodiment.

The jets of FIG. 1C must be spaced far enough apart to ensure that the expanding jets do not overlap such that they begin to adversely interfere with one another. In this regard, the first jet must be placed far enough upstream in the bindery line to interact with a falling signature as soon as it approaches the top edge of the APD vent caps. Similarly, the last jet must be placed far enough downstream in the bindery line to offer the degree of control necessary to prevent dog earring.

The vent caps, too, should be designed to operate as a low-resistance manifold. As a result, the vent caps may port compressed air from the supply line (not shown) to the vent openings. Too much flow resistance will require higher supply line pressure and will create variances in flow rate amongst the individual jets. The vent cap should also be sufficiently curved and finished in order to provide for the requisite coefficient of friction between the cap and signature in order to prevent bouncing and rolling.

Conversely, friction should not be of too high a degree such that the signature no longer slides past the vent cap during transition. The vent cap should be as thin as possible in order to reduce the chances that the lower edge of the signature will come into the cap and not slide past the same. The vent cap may take on many different embodiments including semi-cylindrical or tear-dropped shaped.

The APD plate may be flat, curved, or absent all together. In one embodiment, the lower edge of the APD plate extends beyond the lower edge of the signature. The upstream edge of the APD plate is far enough upstream to interact early with the falling signature (e.g., as soon as the signature approaches the top edge of the APD). The downstream edge of the APD plate should be far enough downstream to ensure control over potential dog ears. In some embodiments, the lower edge of the APD plate may extend beyond the lower edge of the signature.

Figure 2:
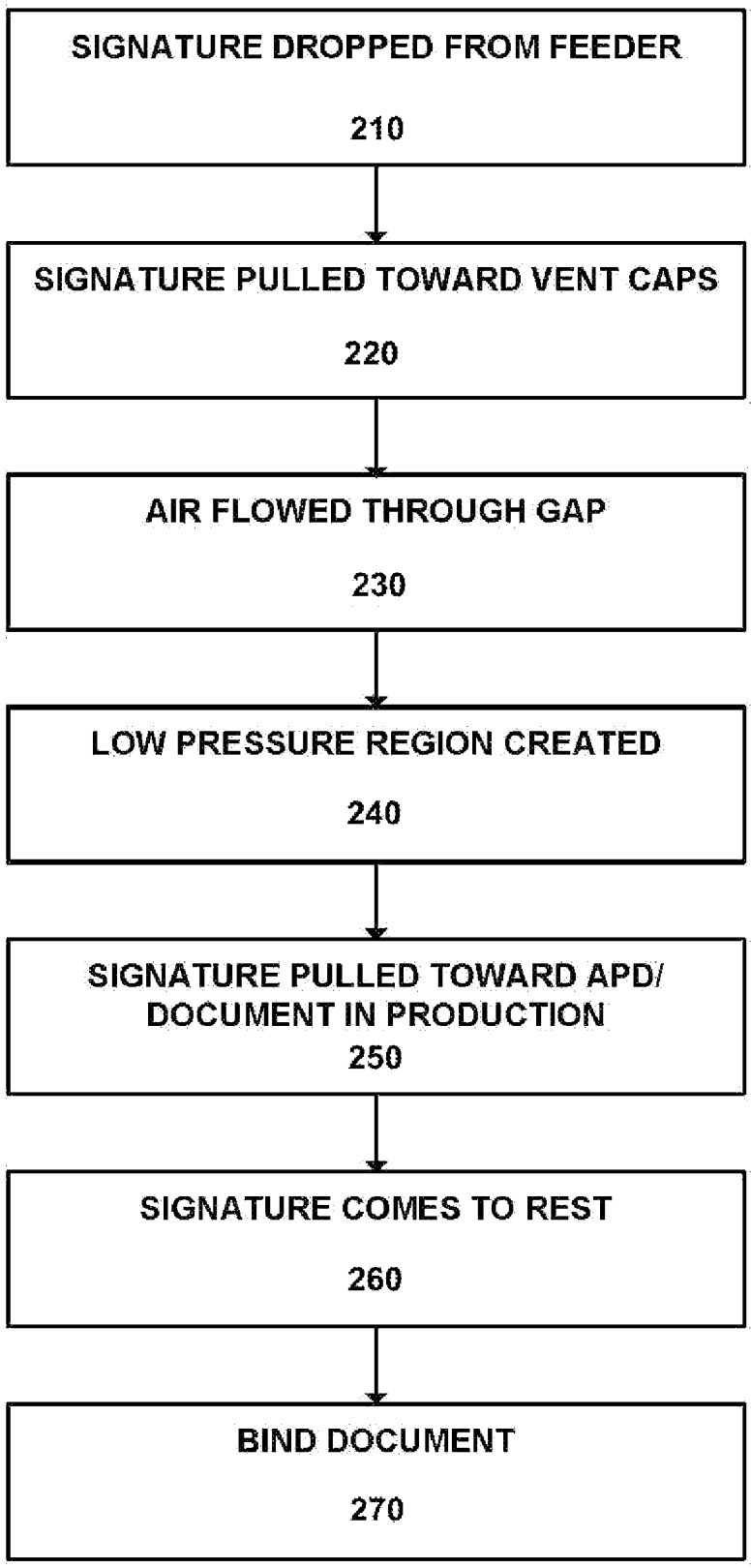
FIG. 2 illustrates a method for gathering, conveying, and binding a signature through use of a presently described APD.

FIG. 2 illustrates a method 200 for gathering, conveying, and binding a signature through use of a presently described APD. Through method 200, multiple feeders are distributed along and vertically disposed above a gathering chain, which transports documents in production to a stitching head. A plurality of vent caps beneath each feeder generate controlled airflows beneath a new signature deposited by the feeder onto the document in production.

A new signature drops down from the feeder (step 210) and approaches the upper edge of the vent caps. The new signature is pulled towards the vent caps by air that is entrained into the vent cap jet streams (step 220). When the new signature approaches the vent caps, air from the jets flows through the gap formed between the new signature and either the APD plate or the document in production (step 230). As this air flows downward in an essentially inviscid manner, the stream expands to create low pressure in the region beneath the new signature (step 240). This low pressure pulls the new signature towards either the APD plate or the document in production (step 250). The new signature then comes to rest on the document in production (step 260). The new signature (and any subsequently received signatures) are then bound with the document in production by the stitching head (step 270).

This methodology eliminates the tendency of the new signature to parachute and dog ear. The downward flowing air stream also acts as an air bearing to promote the smooth and rapid travel of the new signature downward onto the gathering chain. The small but sufficient amount of friction between the vent caps and the new signature that results due to the latter wrapping around the vent caps once the spine of the signature contacts the gathering chain prevents the signature from bouncing and from rolling off of the chain.

While various embodiments have been described above, it should be understood that they have been presented by way of example only, and not limitation. The descriptions are not intended to limit the scope of the invention to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the invention as defined by the appended claims and otherwise appreciated by one of ordinary skill in the art. The scope of the invention should, therefore, be determined not with reference to the above description, but instead should be determined with reference to the appended claims along with their full scope of equivalents For example, the disclosed APD may be used to create local flow fields that move a first flexible membrane in a desired direction. The APD may similarly be used to create a spread jet that creates low pressure fields that attract a first flexible membrane toward a rigid plate or toward a second membrane. The APD may also be used to create an air cushion between a first membrane and a plate or second membrane to minimize contact and friction. The APD may be used to create a jet that moves a first membrane in the direction of a first flow in addition to being configured to use friction to hold a first membrane in a desired position until a secondary jet is activated to break the friction and let the first membrane move with the jet flow.

In addition to being used for the purpose of binding, the APD may transport thin layers of material along a conveyor belt, pick up and transport a first piece of material from a stack of materials, and to hold a resin-filled composite in close proximity to a mold with minimal contact until the resin cures.

What is claimed is:

1. A system for positioning a plurality of signatures for binding, the system comprising:

a gathering chain that transports transport the plurality of signatures to a stitching head;

a plurality of swords, each of the plurality of swords separating a new signature from a document in production;

a plurality of vent caps, each vent cap having no more than three equally spaced openings that create airflow that expands and flows downward in an essentially inviscid manner thereby generating a low-pressure region beneath the new signature when deposited by a feeder onto the document in production, wherein the new signature conforms to and is aligned with the document in production, and does not deviate from the gathering chain as a result of the generation of the low-pressure area; and a stitching head that binds the new signature with the document in production.

2. The system of claim 1, wherein the plurality of vent caps is individually coupled to the plurality of swords.

3. The system of claim 1, wherein the plurality of vent caps is individually integrated into the plurality of swords.

4. The system of claim 1, wherein the low-pressure area further prevents the new signature from dog earring when deposited onto the document in production.

5. The system of claim 1, wherein the low-pressure area further prevents the new signature from parachuting when deposited onto the document in production.

6. The system of claim 1, wherein the low-pressure area further prevents the new signature from bouncing off the gathering chain when deposited onto the document in production.

7. The system of claim 1, wherein the low-pressure area further prevents the new signature from rolling off the gathering chain when deposited onto the document in production.

8. The system of claim 1, wherein the plurality of vent caps is further configured to generate an air bearing effect.

9. The system of claim 1, wherein the plurality of vent caps is further configured to generate friction.

10. The system of claim 1, wherein at least one of the plurality of vent caps is tear drop shaped.

11. The system of claim 1, wherein at least one of the plurality of vent caps is semi-cylindrically shaped.

12. The system of claim 1, wherein the low pressure region is created between the new signature and the document in production.

13. The system of claim 1, wherein the low pressure region is created using a flow rate of approximately five cubic feet per minute.

14. A system for positioning a plurality of signatures for binding, the system comprising:

a gathering chain that transports the plurality of signatures to a stitching head;

a plurality of plates that separate a new signature from a document in production;

a plurality of vent caps, each vent cap having no more than three equally spaced openings that create airflow that expands and flows downward in an essentially inviscid manner thereby generating a low-pressure region beneath the new signature when deposited by a feeder onto the document in production and the plurality of plates, wherein the new signature conforms to the plates, is aligned with the document in production, and does not deviate from the gathering chain as a result of the generation of the low-pressure area; and a stitching head configured to bind the new signature with the document in production.

15. The system of claim 14, wherein the plurality of vent caps are individually coupled to the plurality of plates.

16. The system of claim 14, wherein the plurality of vent caps are individually integrated into the plurality of plates.

17. The system of claim 14, wherein the low-pressure area further prevents the new signature from dog earring when deposited onto the plurality of plates.

18. The system of claim 14, wherein the low-pressure area further prevents the new signature from parachuting when deposited onto the plurality of plates.

19. The system of claim 14, wherein the low-pressure area further prevents the new signature from bouncing off the gathering chain when deposited onto the document in production.

20. The system of claim 14, wherein the low-pressure area further prevents the new signature from rolling off the gathering chain when deposited onto the document in production.

21. The system of claim 14, wherein the plurality of vent caps is further configured to generate an air bearing effect.

22. The system of claim 14, wherein the plurality of vent caps is further configured to generate friction.

23. The system of claim 14, wherein at least one of the plurality of vent caps is tear drop shaped.

24. The system of claim 14, wherein at least one of the plurality of vent caps is semi-cylindrically shaped.

25. The system of claim 14, wherein the low pressure region is created between the new signature and one or more of the plurality of plates.

26. The system of claim 14, wherein the low pressure region is created using a flow rate of approximately five cubic feet per minute.

27. The system of claim 14, wherein one or more of the plurality of plates is flat.

28. The system of claim 14, wherein one or more of the plurality of plates is curved.

* * * * *